US005218790A

United States Patent [19]

Huang

[11] Patent Number: 5,218,790

[45] Date of Patent: Jun. 15, 1993

[54] PNEUMATICALLY OPERATED DEBRIS-REMOVABLE GRINDING TOOL

[76] Inventor: Kan-Chi Huang, No. 3, Alley 3, Lane 1512, Chung Shan Road, Tao Yuan, Taiwan

[21] Appl. No.: 975,054

[22] Filed: Nov. 12, 1992

[51] Int. Cl.[5] ..... B24B 23/02

[52] U.S. Cl. ..... 51/170 T; 51/273

[58] Field of Search ..... 51/170 T, 134.5 F, 180, 51/177, 273

[56] References Cited

U.S. PATENT DOCUMENTS

| | | | |
|---|---|---|---|
| 3,824,745 | 7/1974 | Hutchins | 51/273 |
| 4,355,487 | 10/1982 | Maier et al. | 51/273 |
| 4,765,099 | 8/1988 | Tanner | 51/170 T |
| 4,930,264 | 6/1990 | Huang | 51/170 T |

*Primary Examiner*—Robert A. Rose
*Attorney, Agent, or Firm*—Bacon & Thomas

[57] ABSTRACT

An improved pneumatically operated grinding tool having a debris removing device is primarily equipped with a main body, a pneumatic motor, a lower chamber, an upper and a lower debris intaking wheel, an air guiding disc, a cushion ring, a partition mount and a grinding plate. The grinding plate is provided with a plurality of through holes thereon so as to permit grinding debris to be sucked into the lower chamber therethrough and via the periphery thereof and further led into the lower debris intaking wheel and then the air guiding disc. The upper and lower debris intaking wheels assembled together with the air guiding disc disposed therebetween are both provided with a hexagon-shaped through hole respectively so as to permit the wheels to be fixedly secured in place onto a hexagonal shaft. The additional upper debris intaking wheel disposed on top of the air guiding disc can help introduce grinding debris delivered from the air guiding disc into an outlet and further to a debris outlet duct. The pneumatic motor received in the body drives the upper and lower debris intaking wheels together to generate large vacuum force whereby the grinding debris particles are continuously expelled without accumulating in the lower chamber and the main body even the intaking wheels run at low speed.

5 Claims, 7 Drawing Sheets

PNEUMATICALLY OPERATED DEBRIS-REMOVABLE GRINDING TOOL

BACKGROUND OF THE INVENTION

The present invention relates to an improved pneumatically operated debris removable grinding tool which is provided with an additional upper debris intaking wheel located on top of a fixed air guiding disc so as to effectively increase the suction force thereof whereby the grinding debris particles can be delivered to an outlet of a lower chamber and further into an air outlet duct disposed on the handle of the body even when the debris intaking wheels operate at low speed when the grinding plate abuts against the surface of a working object.

Referring to FIG. 1, a perspective diagram showing the exploded components of a prior art grinding tool disclosed in the present inventor's U.S. Pat. No. 4,930,264 is presented. This prior pneumatically operated grinding device or polishing device is equipped with an air inlet pipe 13, an air outlet pipe 14, an upper chamber 11, a lower chamber 12 on the main body 1 of the polishing device. When high pressure air is led from the air inlet pipe 13 into the upper chamber 11, the rotation shaft 211 of the pneumatic motor 21 is forced to spin with the air guiding blade assembly 22, the debris intaking wheel 23, the partition board 24 and the polishing plate 25 rotating at the same time.

As shown in FIGS. 1, 2, as the debris intaking wheel 23 rotates, an upwardly directed stirred air is produced to introduce the grinding debris into the lower chamber 12 via the through holes 251 of the polishing plate 25 and the through holes 241 of the partition board 24, and the debris particles are further led into the spacings 232 of the debris intaking wheel 23 via the through hole 231 and guided outwardly and then are cast into the center of the air guiding blade assembly 22 via the passages 221 and further led into the upper chamber 11 by way of the through hole 222. As high pressure air is discharged through the outlet port 141 of the air outlet pipe 14, a suction force will be generated as a result of vacuum state at the outlet port 141 so that debris particles can be expelled.

This prior art grinding device has some problems found in practical operation as a result of its imperfect design:

1. The debris particles led into the upper chamber 11 will be accumulated in the peripheral space between the pneumatic motor 21 and the upper chamber 11; and the suction force at the outlet port 141 is limited so that only part of the debris particles at the outlet port 141 are able to be expelled out thereof; in other words, the debris particles all around the peripheral space can not be expelled wholly and most will accumulate in the upper chamber 11 finally; and the polishing device has to be disassembled after a period of time to get the debris particles removed for further use, causing inconvenience to the operator.

2. When the grinding or polishing device is in operation, the body 1 thereof must be pressed downward with force so as to keep the polishing plate 25 in close abutment against the surface of a wood board or a wall or surface of the like to effect the polishing or grinding operation. However, the application of large force to the body 1 will cause the debris intaking wheel 23 to slow down to such an extent that the upward suction force will decline greatly, resulting in the debris particles scattered all around without being sucked therein in the practical operation.

3. The rotation shaft 211 of the pneumatic motor 21 is made in a cylindrical form so that the fixing of the air guiding blade assembly 22, the debris intaking wheel 23 to the rotation shaft 211 becomes rather difficult.

SUMMARY OF THE INVENTION

The primary object of the present invention is to provide an improved pneumatically operated debris removable grinding tool which is equipped with an additional upper debris intaking wheel so as to make the grinding debris particles sucked into the lower chamber thereof to be expelled therefrom totally without accumulating in the lower chamber or the main body.

Another object of the present invention is to provide an improved grinding tool which is provided with a pair of debris intaking wheels that are able to produce strong suction force even when the operation speed of the pneumatic motor is greatly reduced as a result of forced abutment of the grinding plate against the surface of a working object.

One further object of the present invention is to provide an improved grinding tool which is provided with a pair of debris intaking wheels each having a hexagon shaped through hole that is engaged with a hexagonal driving shaft and supported in place by a pair of supporting rings so as to permit the wheels to be firmly fixed in place without slippage even operated at a high speed.

DETAILED DESCRIPTION OF THE PREFERRED EMBODIMENT

Figure 1:
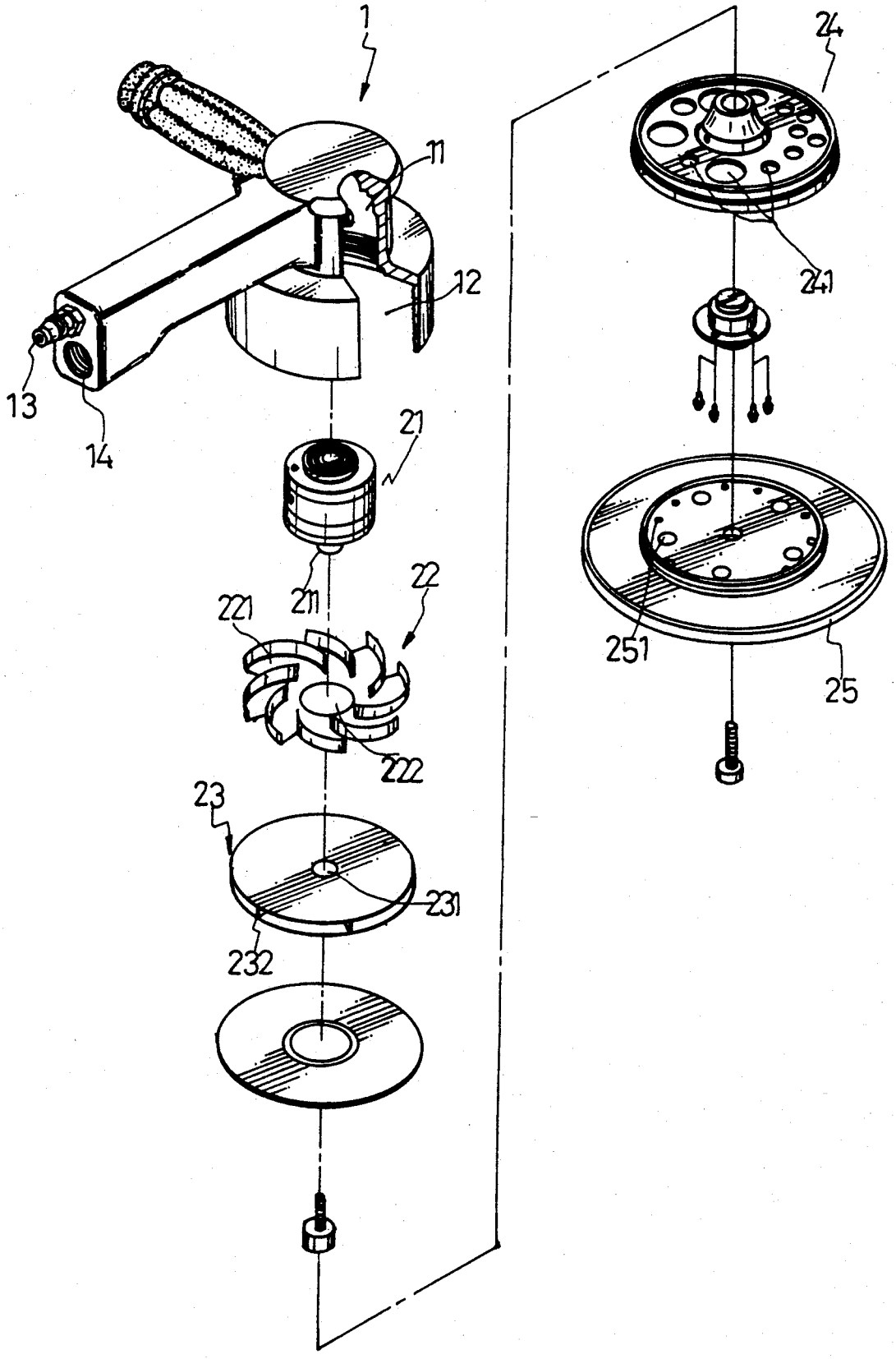
FIG. 1 (PRIOR ART)
FIG. 1 is a perspective diagram showing the exploded componets of a prior art grinding tool.
Figure 2:
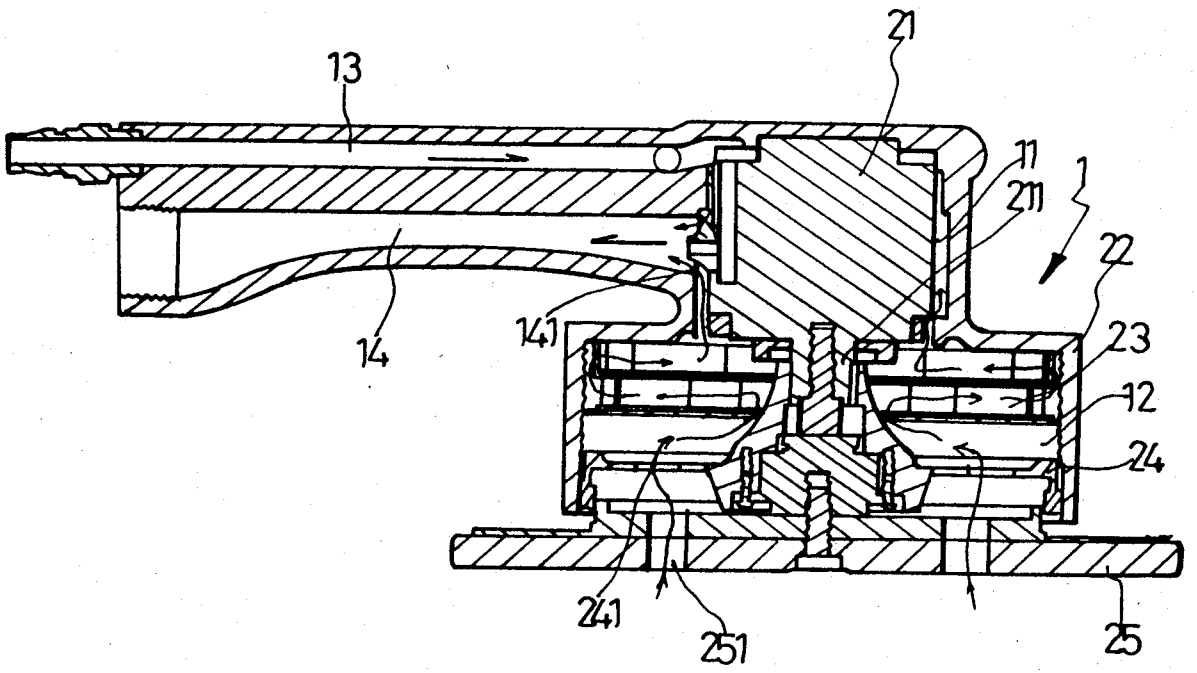
FIG.2 (PRIOR ART)
FIG. 2 is a sectional diagram showing the operation of the prior art grinding tool shown in FIG. 1.
Figure 3:
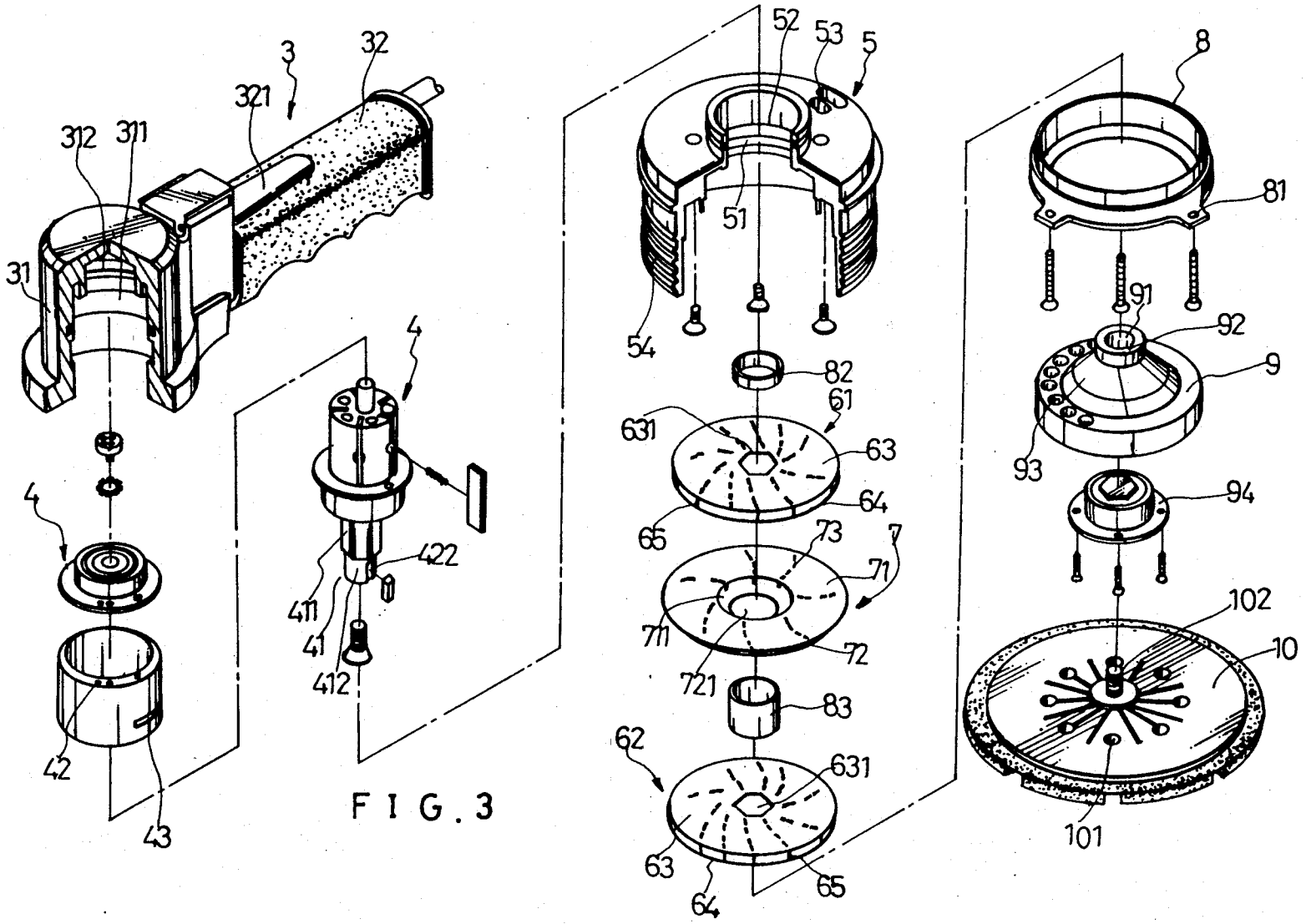
FIG. 3 is a perspective diagram showing the exploded components of the improved grinding tool of the present invention.

Referring to FIG. 3, the exploded components of the present improved pneumatically operated debris removable grinding tool is perspectively shown; it is comprised of a main body 3, a pneumatic motor 4, a lower chamber 5, an upper debris intaking wheel 61, a lower debris intaking wheel 62, an air guiding disc 7, a cushion ring 8, a partition mount 9, a circular grinding plate 10.

The main body 3 is equipped with an upper air chamber 31 and a handle 32 in which are disposed an air inlet duct 33 and an air outlet duct 34. High pressure air can be led into the air inlet duct 33 and discharged outwardly along with the grinding debris particles via the air outlet duct 34. A press type control button 321 is disposed at the top of the handle 32 for control of the volume of high pressure air introduced into the air inlet duct 33. A peripherally defined discharge groove 311 is disposed on the inner wall of the upper air chamber 31 and a rubber sealing ring 312 is used to keep the inlet air and outlet air separated.

Figure 3A:
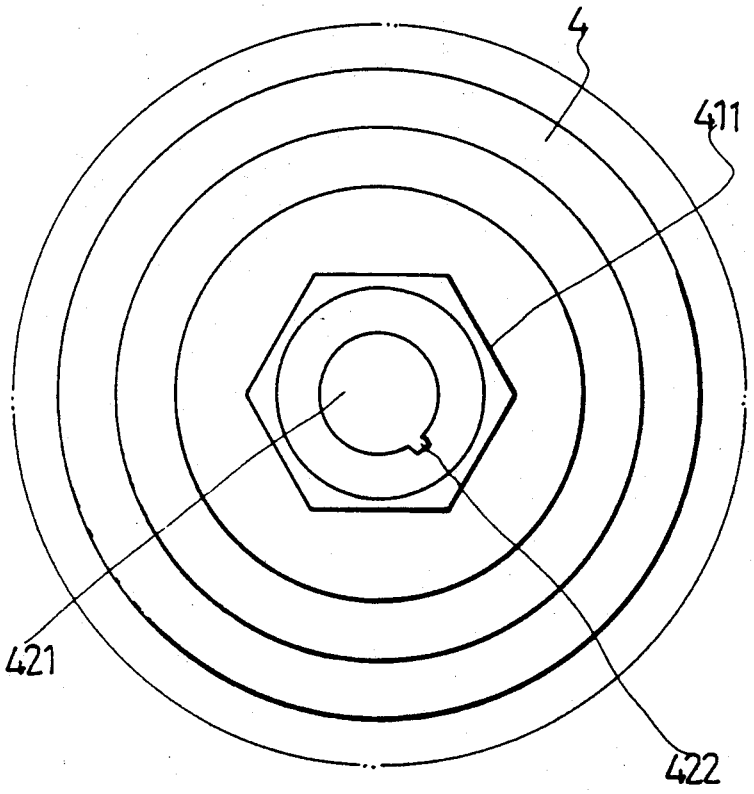
FIG. 3A is a bottom view of the pneumatic motor thereof.
Figure 4:
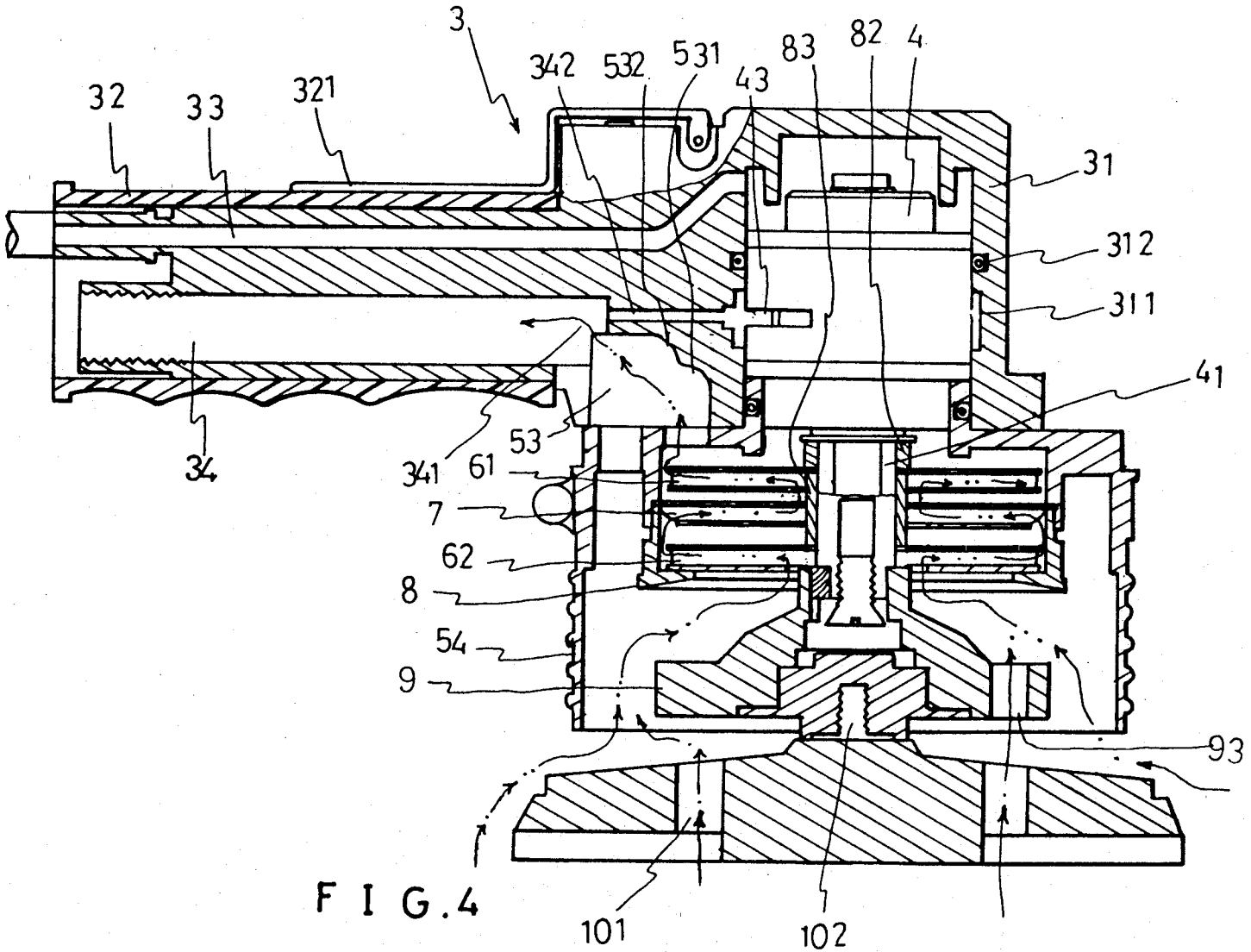
FIG. 4 is a sectional diagram showing the operation of the present grinding tool.

Referring to FIGS. 3, 4, the pneumatic motor 4 is disposed inside the upper air chamber 31 of the main body 3 with the end of the air inlet duct 33 located above the air inlet pores 42 of the pneumatic motor so that high pressure air can be led thereinto to make the driving shaft 41 rotate, and then be discharged via an air outlet slot 43 on the outer case of the motor 4. The an air outlet slot 43 is in communication with an end of a thin tube 342 communicating with the end port 341 of the air outlet duct 34 at the other end thereof. As shown in FIG. 3A, the top portion 411 of the driving shaft 41 is made in a hexagonal shape and a screw hole 421 and a keyway 422 are disposed on the extended cylindrical bottom portion 412 of the driving shaft 41, as shown in FIG. 3A.

Referring to FIGS. 3, 4, the lower chamber 5 has a hollow interior and is provided with a peripheral fixing recess 51 near the bottom thereof and a number of screw holes and a through hole 53 at the top thereof; and a flexible bellow-like rubber skirt 54 is attached thereto. The through hole 53 communicates with the end port 341 of the air outlet duct 34. There are two consecutive curved flow guiding portions 531, 532 disposed right above the through hole 53 so as to facilitate the discharge of the debris particles through the through hole 53 smoothly.

Figure 6:
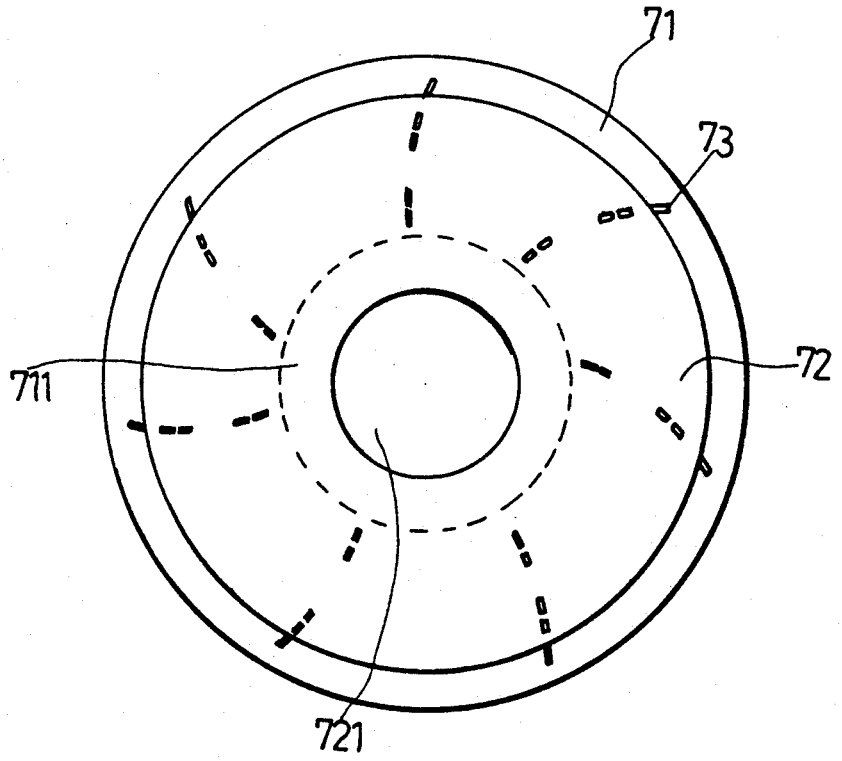
FIG. 6 is a diagram showing the structure of the air guiding disc of the present invention.
Figure 7:
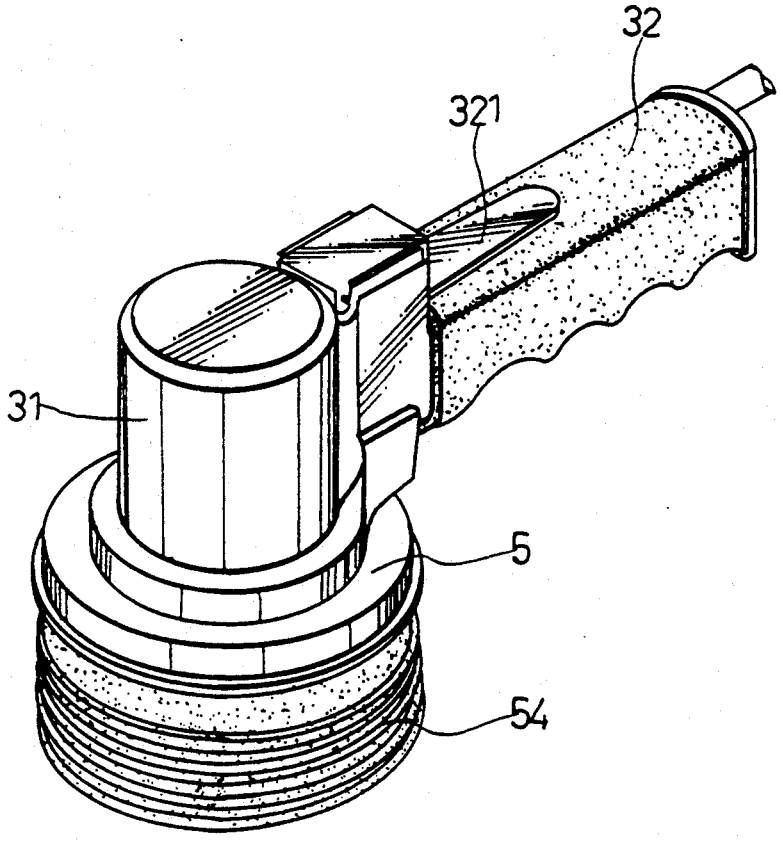
FIG. 7 is a perspective diagram showing the grinding tool of the present invention.

Referring to FIG. 6, the air guiding disc 7 located in the peripheral fixing recess 51 defined on the inner wall of the lower chamber 5 and supported in place by the cushion ring 8 is provided with an upper plate 71, a lower plate 72 and a plurality of vertically placed partition members 73 each spacedly disposed between the upper and lower plates 71, 72. A through hole 711 and 721 is disposed at the center of the upper plate 71 and lower plate 72 respectively wherein the diameters of the through hole 711 and the through hole 721 are both larger than the cross section of the driving shaft 41 so that it can be held in place in the peripheral fixing recess 51 without moving together with the driving shaft 41. The upper plate 71 is larger than the lower plate 72 with the through hole 711 larger than the through hole 721 so as to permit air flow to be led into the spacings defined by the partition members 73 from the periphery of the air guiding disc 7 and further led upwardly via the through hole 711.

Figure 5:
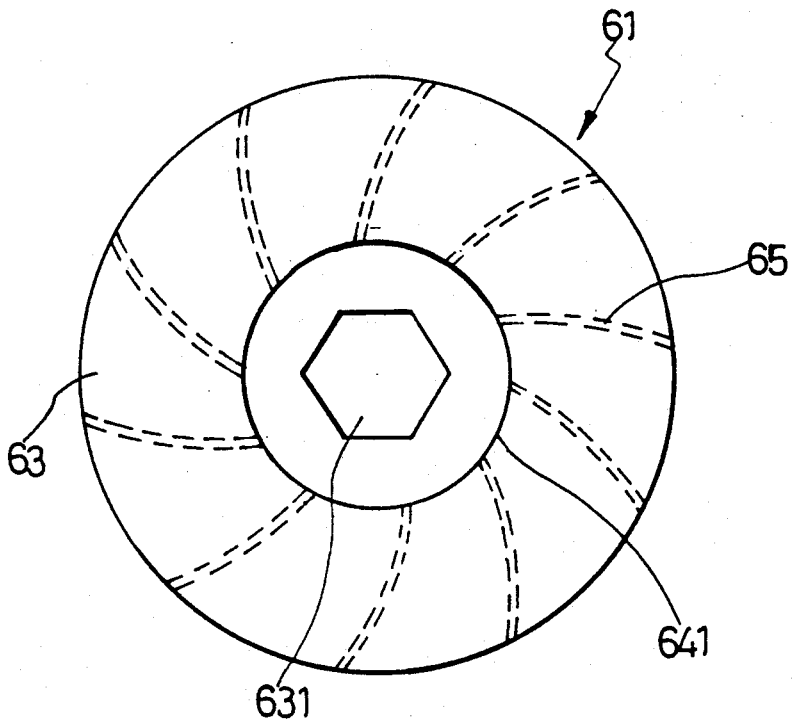
FIG. 5 is a diagram showing the structure of the debris intaking wheel of the present invention.

As shown in FIGS. 3, 5, both the upper and lower debris intaking wheels 61, 62 are made up of an upper plate 63 and a lower plate 64 and a plurality of vertically disposed curved partition members 65 that are spacedly disposed with each other between the upper and lower plates 63, 64. The upper debris intaking wheel 61 is disposed above the air guiding disc 7 and the lower debris intaking wheel 62 is located under the air guiding disc 7. The upper plate 63 is provided, at the center thereof, with a hexagon shaped through hole 631 which is smaller than the through hole 641 so as to permit air to flow upwardly into the spacings between the vertical partition members 65. The top portion 411 of the hexagonal driving shaft 41 can be firmly engaged with the hexagon shaped through holes 631 so that the upper and lower debris intaking wheels can rotate with the driving shaft 41.

Referring to FIG. 3, between the pneumatic motor 4 and the upper debris intaking wheel 61 is disposed an upper supporting ring 82 which is in abutment with the bottom of the pneumatic motor 4 at one end and with the upper plate 63 at the other end; and a lower supporting ring 83 going through the through holes 711, 721 of the air guiding disc 7 which is located in the peripheral fixing recess 51 by the cushion ring 8 without moving is disposed between the upper and lower debris intaking wheels 61, 62 with one end thereof in abutment with the upper plate 63 of the upper debris intaking wheel 61 and the other end against the upper plate 63 of the lower debris intaking wheel 62 so as to support the wheels 61, 62 in place and keep the same separated from the air guiding disc 7, permitting the upper and lower debris intaking wheels 61, 62 to rotate together with the driving shaft smoothly.

The cushion ring 8 is provided with a number of screw holes 81 on the bottom periphery thereof so as to permit the same to be removably attached to the lower chamber 5 as shown in FIG. 4.

There are a plurality of through holes 93 disposed on the periphery of the partition mount 9 which is provided with a central shaft mounting hole 91 having a keyway 92 disposed on the inner wall thereof which is in alignment with the keyway 422 disposed on the driving shaft 41 so that the partition mount 9 when fixed in place can rotate with the driving shaft 41. The partition mount 9 can be secured to the driving shaft 41 by using a screw which is led through a screw hole (not shown) concealed in the shaft mounting hole 91 and the screw hole 421 on the driving shaft 41.

Under the partition mount 9 is disposed a fixing block 94 having a screw hole (not shown) disposed thereon with a number of screw holes disposed on the periphery thereof whereby the fixing block 94 can be secured to the partition mount 9.

The circular grinding plate 10 is provided with a plurality of intaking through holes 101 thereon with a protruded screw 102 disposed at the center thereof so as to permit the grinding plate 10 to be engaged with the screw hole on the fixing block 94 so as to permit the same to be fixed thereto.

Referring to FIGS. 3, 4, it can be clearly seen that as the upper and lower debris intaking wheels 61, 62 are rotating, an upwardly directed suction force is generated as a result of the high pressure air led into the air outlet duct, permitting grinding debris particles to be introduced into the lower chamber 5 by way of the intaking through holes 101, the through holes 93 and the peripheral space of the grinding plate 10, and the delicate debris particles are further led into the through holes 641 of the lower debris intaking wheel 62 and discharged out thereof via the spacings defined by the vertical partition members 65 and then delivered to the air guiding disc 7 from the bottom periphery thereof, as indicated by the arrows, and further delivered by way of the arc partition members 73 out of the air guiding disc via the central through hole 711; and the discharged debris particles are brought into the spacings defined by the arc partition members 63 by way of the through hole 641 of the upper debris intaking wheel 61; and the debris particles are continually brought to the vinicity of the through hole 53 of the lower air chamber as a result of the rotation of both the upper and lower debris intaking wheels 61, 62.

As high pressure air is introduced into the thin tube 342 from the pneumatic moter 4 by way of the air outlet slot 43, the speed of the air flow will be increased according to the famous Bernoullis' theorem, and the diameter of the thin tube 342 is smaller than that of the end port 341 of the air outlet duct 34 so that when the high pressure air flows into the port 341 from the tube 342, there will be a vacuum Produced thereat which can suck the debris particles at the through hole 53 into the port 341 of the air outlet duct 34 and further discharged therefrom.

In summary, there are a number of advantages associated with the present invention:

1. The additional debris intaking wheel 61 can bring grinding debris particles continuously to the vicinity of the through hole 53 of the lower chamber 5 and the same will be expelled out thereof by way of the air outlet duct 34 along with the high pressure air whereby no debris residue will accumulate in the lower chamber 5.

2. The use of the dual upper and lower debris intaking wheels 61, 62 enables the present grinding tool to generate strong suction force so that even the debris intaking wheels are forced to slow down as a result of the grinding plate being in close abutment against the surface of a working object, there is still adequate suction force produced to introduce debris particles into the lower chamber 5 and discharge the same therefrom.

3. The hexagonal driving shaft 41 engaged with the hexagon shaped through holes 631 of the upper and lower debris intaking wheels 61, 62 are able to fix the wheels firmly in place with the help of the upper and lower supporting rings 82, 83 whereby the upper and lower debris intaking wheels can rotate without slippage along with the driving shaft.

It is to be understood that the present invention is not limited to the embodiment described above, and that various changes and modifications may be effected therein by one skilled in the art without departing from the scope or spirit of the invention.

I claim:

1. An improved pneumatically operated debris removing grinding tool, comprising:

a main body being provided with an upper chamber and a handle in which are disposed an air inlet duct and an air outlet duct;

a pneumatic motor disposed in said upper chamber having a driving shaft extended therefrom;

a lower chamber being removably secured to said main body by fastening means with a flexible rubber skirt attached thereto;

an upper and a lower debris intaking wheel;

an air guiding disc sandwiched between said upper and lower debris intaking wheels that are housed in said lower chamber with said driving shaft going therethrough;

a cushion ring removably attached to the bottom of said lower chamber and in supporting abutment against said air guiding disc; a partition mount having a plurality of through holes disposed on the periphery thereof and a shaft mounting hole disposed at the center thereof into which said driving shaft is inserted and fixed to said driving shaft;

a fixing block removably secured to said partition mount by fastening means;

a circular grinding plate removably secured to said fixing block being provided with a plurality of through holes thereon through which debris particles can pass;

said lower chamber associated with said flexible skirt; and a through hole in communication with an end port of said air outlet duct being disposed at the top of said lower chamber;

said pneumatic motor being provided with a driving shaft and a number of air inlet pores and an air outlet slot thereon; said outlet slot communicating with a thin tube having a diameter smaller than said end port of said air outlet duct so that when high pressure air passes through said air outlet slot and said thin tube and enters said end port of said air outlet duct, a vacuum state will be generated thereat;

each of said upper and lower debris intaking wheels being provided with an upper plate and a lower plate with a plurality of vertically disposed arcuate partition members located therebetween that are equally spaced so as to form a plurality of spacings accordingly;

said upper and lower debris intaking wheels being securedly engaged with said driving shaft of said pneumatic motor;

whereby as said pneumatic motor is actuated to rotate by high pressure air introduced through said air inlet duct, said upper and lower debris intaking wheels are made to move accordingly so as to suck grinding debris particles into said lower chamber via said through holes on said grinding plate and along the periphery thereof and then via said through holes and along the periphery of said partition mount; and further via said lower debris intaking wheel and said air guiding disc which is retained in place without rotation and then said upper debris intaking wheel and the debris particles being finally delivered to said through hole disposed at the top of said lower chamber and communicating with said end port of said air outlet duct at which location said debris particles are sucked out by vacuum produced as a result of the high pressure air coming out of said thin tube slowing down thereat.

2. An improved pneumatically operated debris removing grinding tool as claimed in claim 1 wherein said driving shaft extended from said pneumatic motor has an top portion made in hexagonal shape and an extended bottom portion made in cylindrical shape.

3. An improved pneumatically operated debris removing grinding tool as claimed in claim 1 wherein each said upper plate of said upper and lower debris intaking wheels is provided with a hexagonal through hole so as to permit said hexagonally shaped top portion of said driving shaft to be fixed therein and retain said upper and lower debris intaking wheels firmly in place by engagement with said driving shaft when rotating at high speed without slippage; each said lower plate of said upper and lower debris intaking wheels is provided with a circular through hole at the center thereof which is large enough to permit the passage of debris particles to go therethrough when mounted to said driving shaft.

4. An improved pneumatically operated debris removing grinding tool as claimed in claim 1 wherein said upper debris intaking wheel is rotatably retained in place by way of being in abutment with an upper supporting ring disposed on top of said upper plate thereof and in contact with said pneumatic motor and a lower supporting ring disposed through the center of said air guiding disc and in abutment against said upper plate of said upper debris intaking wheel at one end and in abutment against said upper plate of said lower debris intaking wheel on opposite end; and said lower debris intaking wheel is supported in place by said cushion ring.

5. An improved pneumatically operated debris removing grinding tool as claimed in claim 1 wherein said air guiding disc is equipped with an upper and lower plate with the former larger than the latter; and a plurality of vertically placed arc partition members dispose therebetween, forming a plurality of spacings accordingly; said upper plate and said lower plate is provided with a circular through hole respectively with the one on said upper plate larger than that on said lower plate and the diameter of the smaller through hole is larger than those of the lower supporting ring and said driving shaft of said pneumatic motor so that said air guiding disc will not move with said driving shaft in operation; and said upper plate of said air guiding disc is retained in place by said cushion ring and located in a peripheral fixing recess disposed on the inner wall of said lower chamber.

* * * * *